United States Patent [19]

Nichelson et al.

[11] Patent Number: 4,796,878

[45] Date of Patent: Jan. 10, 1989

[54] DOCUMENT HANDLING COUNTING APPARATUS

[75] Inventors: William Nichelson, Willow Grove; Gordon H. Groff, Bristol; Paul C. Jones, Philadelphia, all of Pa.

[73] Assignee: Brandt, Incorporated, Bensalem, Pa.

[21] Appl. No.: 40,742

[22] Filed: Apr. 20, 1987

Related U.S. Application Data

[63] Continuation of Ser. No. 796,115, Nov. 8, 1985, abandoned.

[51] Int. Cl.[4] ..... B65H 3/06

[52] U.S. Cl. ..... 271/10; 271/121

[58] Field of Search ..... 271/4, 6, 10, 37, 121, 271/122, 124

[56] References Cited

U.S. PATENT DOCUMENTS

| | | | |
|---|---|---|---|
| 2,820,408 | 1/1958 | Williams | 271/124 |
| 3,768,803 | 10/1973 | Stange | 271/121 |
| 3,838,851 | 10/1974 | Kolibas | 271/124 |
| 3,857,559 | 12/1974 | McInerny | 271/122 |
| 3,944,209 | 3/1976 | Fallos | 271/121 |
| 3,944,210 | 3/1976 | McInerny | 271/122 |
| 3,986,712 | 10/1976 | Hasegawa | 271/124 |
| 4,114,870 | 9/1978 | Di Blasio | 271/122 |
| 4,128,236 | 12/1978 | Lundblad | 271/35 |
| 4,216,952 | 8/1980 | McInerny | 271/122 |
| 4,283,708 | 8/1981 | Lee | 209/534 |
| 4,313,598 | 2/1962 | Di Blasio | 271/124 |
| 4,416,449 | 11/1983 | McInerny | 271/124 |
| 4,443,006 | 4/1984 | Hasegawa | 271/124 |
| 4,474,365 | 10/1984 | Di Blasio | 271/124 |
| 4,555,103 | 11/1985 | Larson | 271/121 |
| 4,560,154 | 12/1985 | Nogi et al. | 271/122 |
| 4,568,074 | 2/1986 | Murayoshi | 271/121 |
| 4,615,518 | 10/1986 | Di Blasio | 271/10 |

FOREIGN PATENT DOCUMENTS

| | | | |
|---|---|---|---|
| 0033331 | 4/1981 | Japan | 271/122 |
| 0001135 | 1/1982 | Japan | 271/121 |
| 2029377 | 3/1980 | United Kingdom | 271/124 |

*Primary Examiner*—H. Grant Skaggs

*Attorney, Agent, or Firm*—Shenier & O'Connor

[57] ABSTRACT

Sheet handling and counting apparatus comprising cooperating stripper shoes and feed rollers forming a feed nip which strips multiple fed sheets causing sheets to be delivered from a feed nip one at a time toward an acceleration nip. The orientation of the stripper shoe relative to the feed roller and the input tray provides excellent stripping action while preventing damage to the sheets being handled. The acceleration nip is formed by cooperating acceleration idlers and O-rings supported by acceleration rollers for accelerating sheets entering the acceleration nip to form a gap between adjacent sheets which aids in the counting of sheets. The stripper shoe is mounted within a clip which also serves to protect the forward end surface of the stripper shoe as well as providing a low friction guide surface engaged by the leading edges of sheets approaching the feed nip. The acceleration rollers drive freewheeling acceleration idlers provided on a common shaft with the feed roller by way of O-rings which further cooperate with dancer rollers to facilitate the feeding of light, thin documents into the feed nip. The O-rings increase the path length between the feed and acceleration nips facilitating the handling of sheets over a broad range of sheet length, measured in the feed direction. Feed idlers cooperate with the feed roller to provide an additional driving nip for directing sheets leaving the curved path leading out of the feed nip toward the acceleration nip. The O-rings provide a greater path length between the feed and acceleration nips to permit the handling of a wide range of sheet sizes with the need for any mechanical adjustment. Sheet feeding is accomplished without the need for an electromagnetic brake and clutch which devices are required in conventional apparatus.

6 Claims, 11 Drawing Sheets

DOCUMENT HANDLING COUNTING APPARATUS

This is a continuation of co-pending application Ser. No. 796,115, filed on Nov. 8, 1985, now abandoned.

FIELD OF THE INVENTION

The present invention relates to document handling and counting apparatus and more particularly to novel document handling and counting apparatus in which document sheets and bills of varying size may be handled without adjustment in the document handling apparatus.

BACKGROUND OF THE INVENTION

Apparatus presently exists for handling, counting and stacking sheets such as paper currency, checks, food stamps and the like. One apparatus which is highly advantageous for counting and stacking sheets is described in copending application Ser. No. 449,665 filed Dec. 14, 1982, now U.S. Pat. No. 4,615,518 issued Oct. 3, 1986 and assigned to the assignee of the present invention.

The above-mentioned copending application employs a technique for accurately controlling the feeding of sheets to the outfeed stacker, which technique is required in order to perform batching and/or counterfeit detection operations. The technique employed in the above-mentioned copending application utilizes electromagnetic brake and clutch mechanisms to perform the above-identified operations.

The apparatus of the above-mentioned copending application employs a feed roller and cooperating stripper shoes for feeding sheets one at a time through the sensing and counting devices. It has been found that the mechanism employed for feeding and stripping sheets has the disadvantages of causing damage to the edges of the sheets as well as causing streaking and/or scuffing of the sheets, and especially stiff new sheets such as new paper currency.

BRIEF DESCRIPTION OF THE INVENTION

The present invention provides improved sheet handling and counting apparatus which is characterized by comprising means which is greatly simplified as compared with the apparatus of the above-mentioned copending application for handling and counting sheets and which, for example, totally eliminates the need for electromagnetic clutch and brake means while at the same time, being capable of performing all of the operations previously requiring such apparatus.

The sheet handling and counting apparatus of the present invention comprises a feed roller directly coupled to a drive motor. The drive coupled to the feed roller is also directly coupled to the picker roller utilized for advancing the bottom sheet from an input tray to the feed roller.

A pair of acceleration rollers are directly driven by the feed roller and cooperate with a pair of acceleration idlers for accelerating sheets fed into the nip between said acceleration rollers and idlers for delivering and rapidly urging the sheets toward an output stacker.

The output stacker includes stacker wheels coupled to the drive motor through a one-way clutch which enables freewheeling rotation of the stacker wheels even after the motor has been abruptly halted.

An idler roller cooperates with the feed roller for positively advancing sheets toward the acceleration nip.

The large diameter acceleration rollers and cooperating idler impart more positive acceleration drive to the sheets while at the same time operating at reduced angular velocity as compared with prior art techniques. The use of a dynamic braking technique provides feeding of only those sheets desired to be fed to output stacker, while eliminating the need for the electromagnetic clutch and brake required in prior art apparatus.

The orientation of the strippers relative to the feed roller and the path of incoming sheets is such as to substantially totally eliminate scuffing and damaging of the sheets being handled and counted.

The apparatus further employs a dancer roller assembly which cooperates with the feed roller to provide sufficient drive for advancing the last few sheets in a stack to the feed nip to assure positive feed to these sheets as well as facilitating the handling of light, fluffy sheets.

OBJECTS OF THE INVENTION AND BRIEF DESCRIPTION OF THE FIGURES

It is therefore one object of the present invention to provide a novel sheet handling and counting apparatus of simplified design which is capable of handling and counting sheets of various sizes without mechanical adjustment.

Still another object of the present invention is to provide novel apparatus for handling and counting sheets and which is capable of accurately controlling the feeding of sheets to the output stacker while eliminating the need for electromagnetic clutch and brake devices required in conventional apparatus.

Still another object of the present invention is to provide a novel feed and stripper arrangement which substantially eliminates the scuffing and wearing of sheets handled by the apparatus.

The above as well as other objects of the present invention will become apparent when reading the accompanying description and drawing in which.

Figure 1:
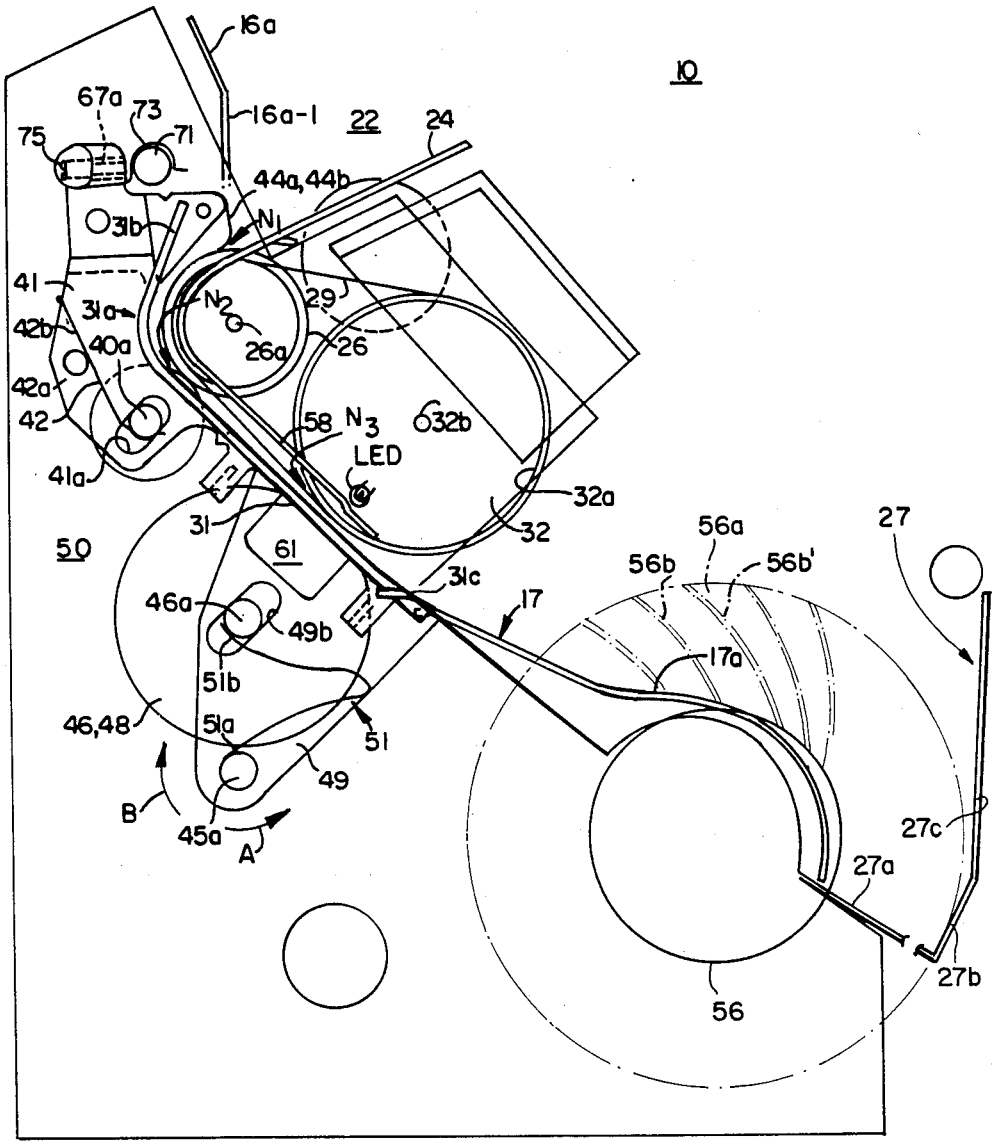
FIG. 1 shows an elevational view of sheet handling and counting apparatus design in accordance with the principles of the present invention.
Figure 3:
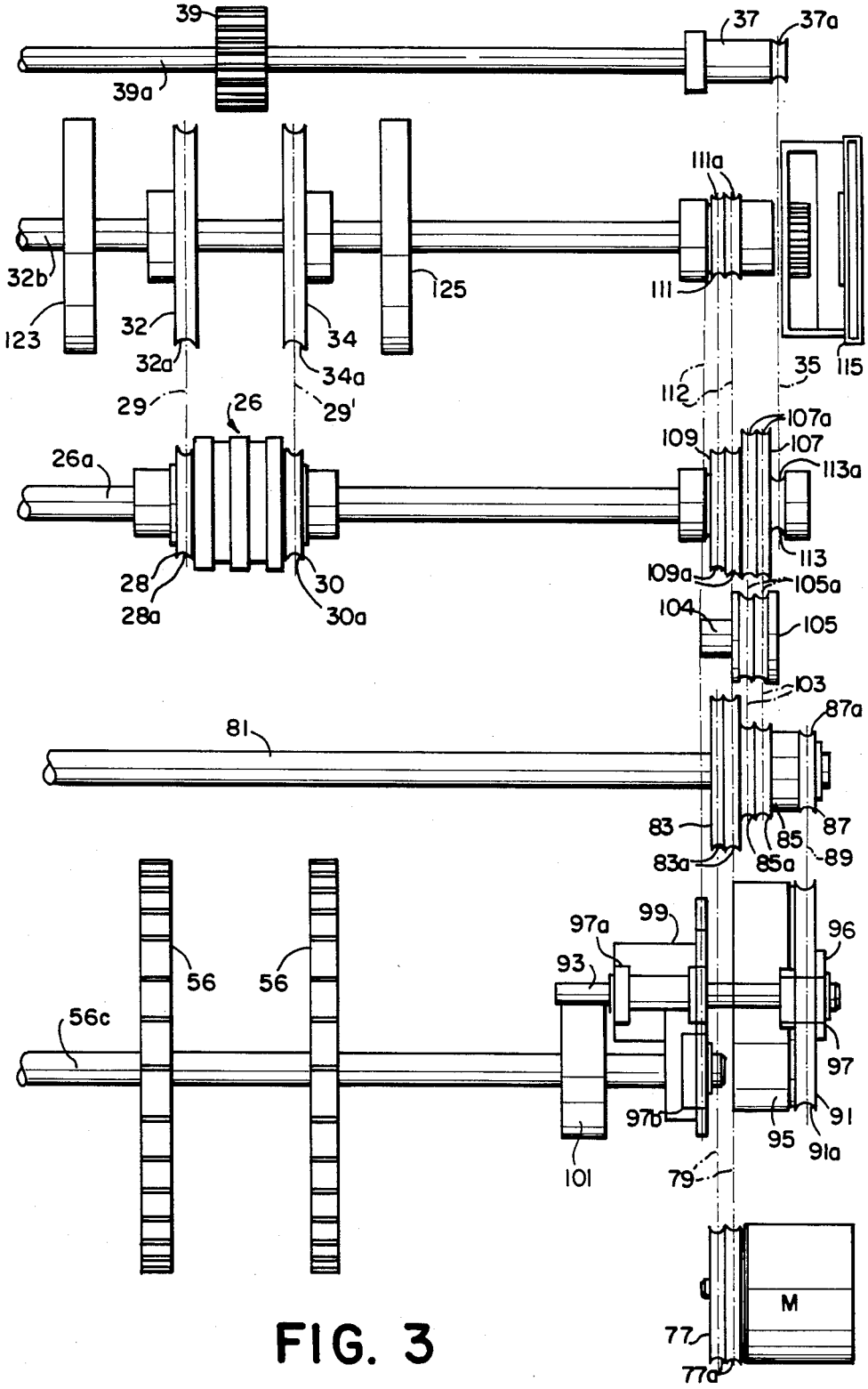
FIG. 3 is a simplified diagramatic view showing the drive train for the sheet handling and counting apparatus shown in FIG. 1.
Figure 3A:
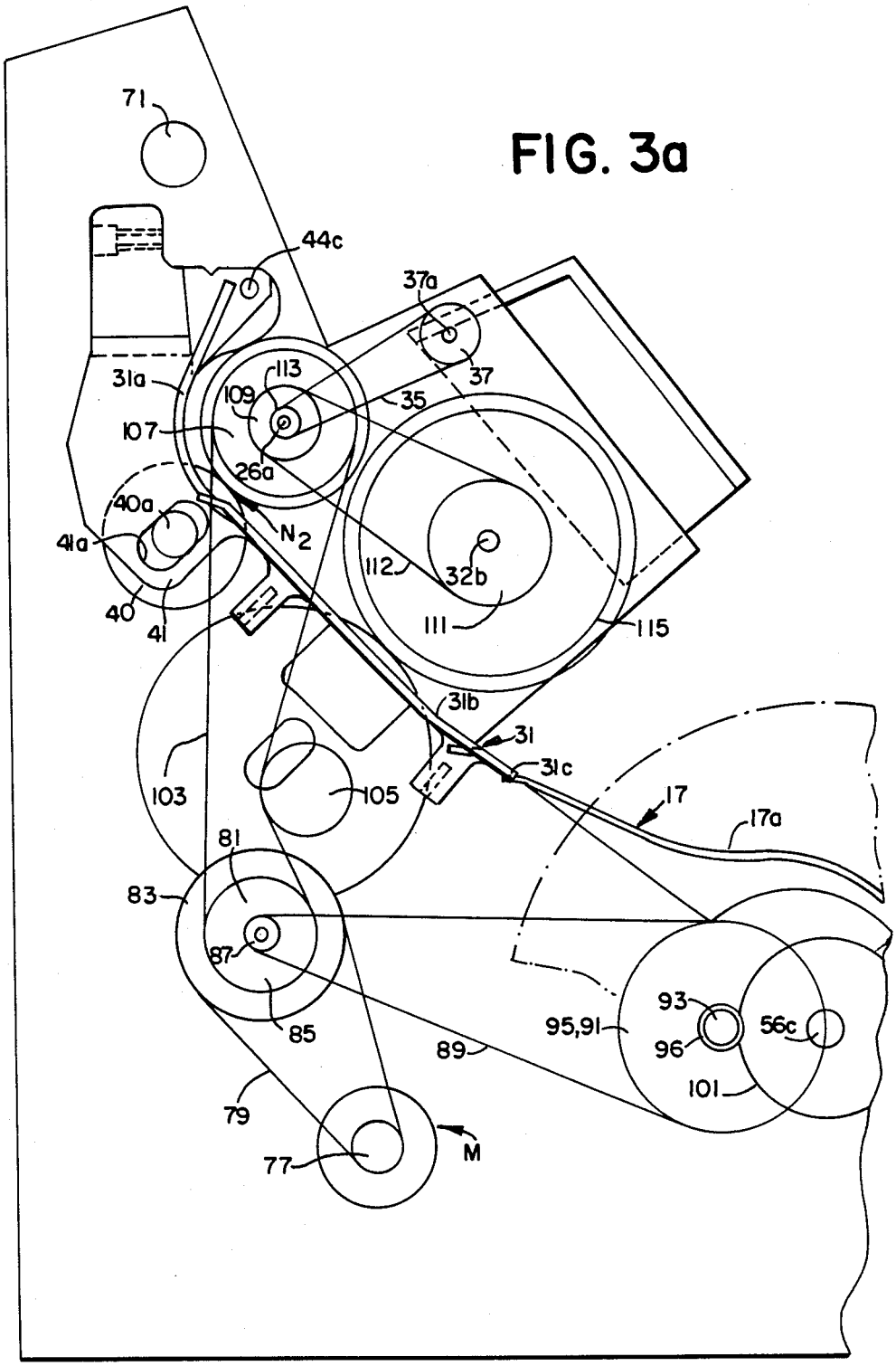

FIG. 3*a* is a diagrammatic elevational view of the apparatus of FIG. 1 showing the drive train of the apparatus.

Figure 4A:
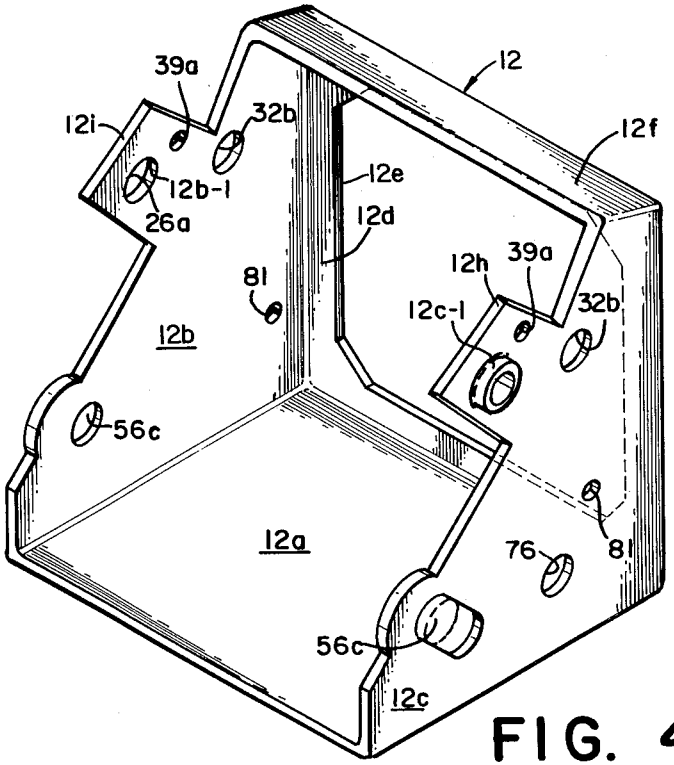
Figure 4B:
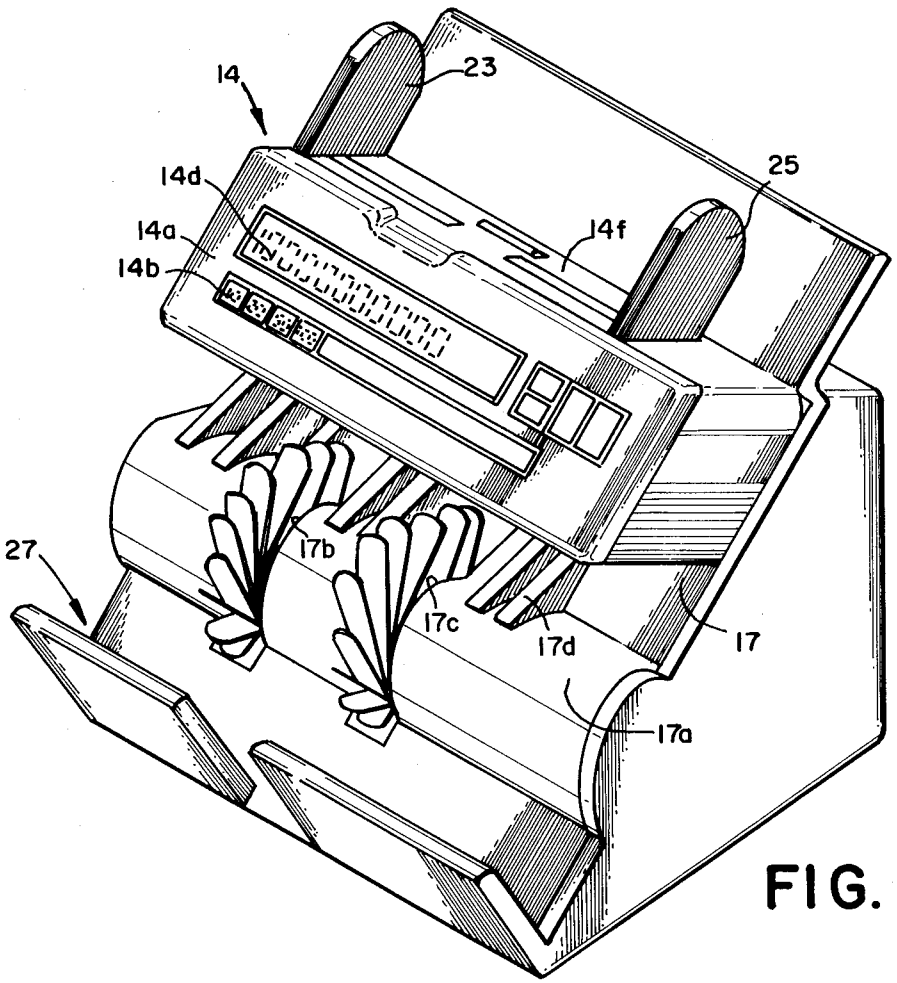
Figure 5A:
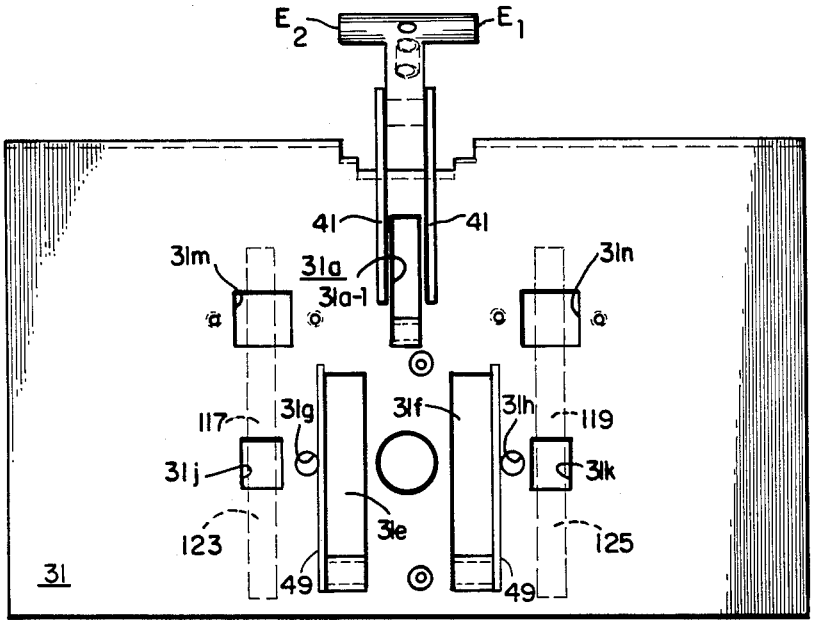
Figure 5B:
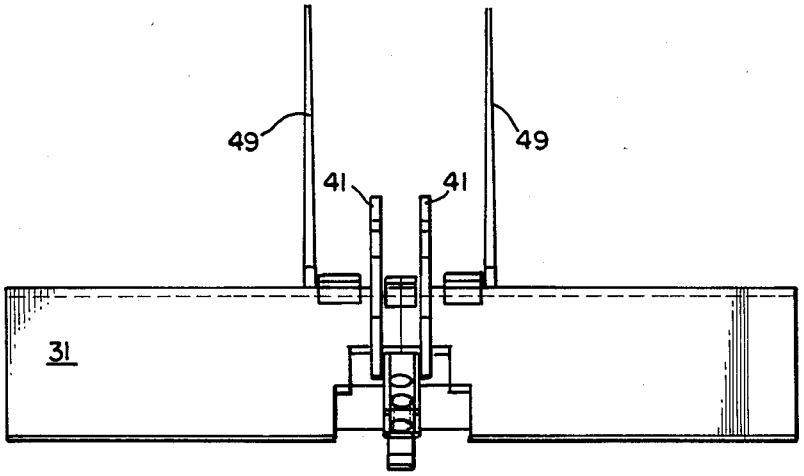
Figure 5C:
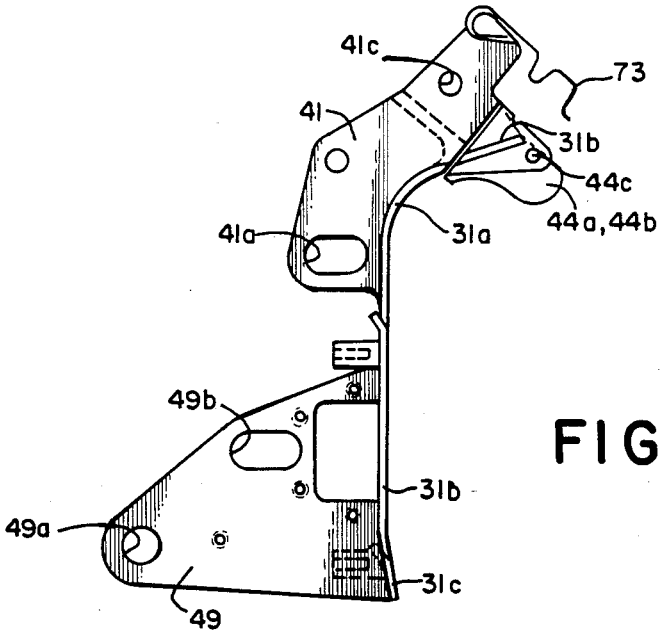
Figure 5D:
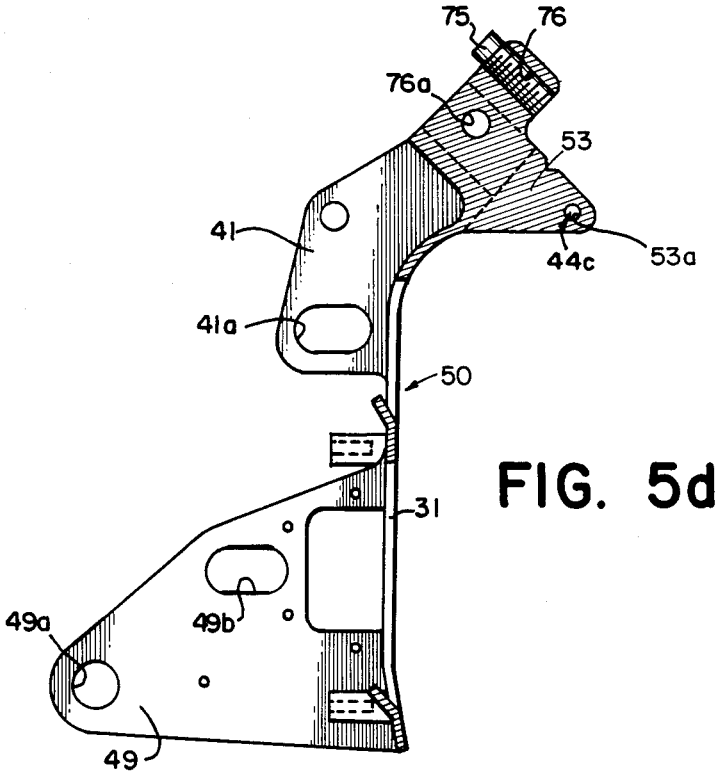
Figure 5E:
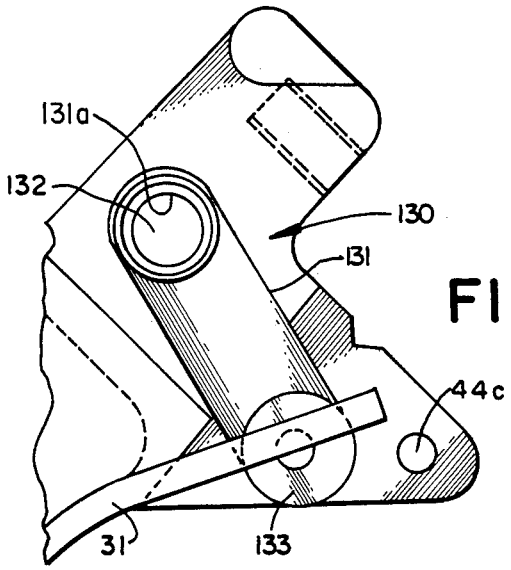
Figure 5F:
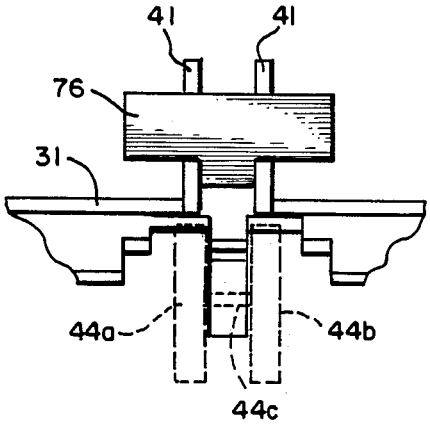

FIGS. 4*a* and 4*b* show perspective views of the enclosure portions making up the enclosure for the sheet handling and counting apparatus of FIG. 1.

FIGS. 5*a*–5*f* shows views of the assembly for mounting the stripper shoes and acceleration and feed pinch rollers shown in FIG. 1.

Figure 6A:
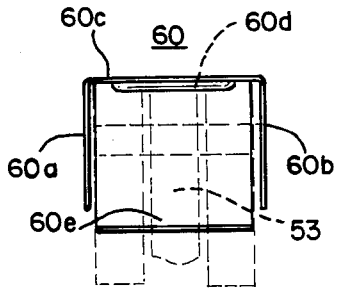
Figure 6B:
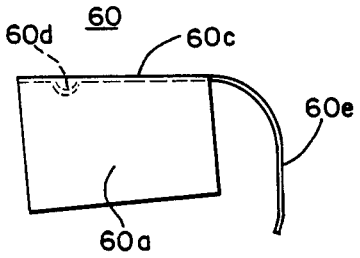

FIGS. 6*a* and 6*b* show side end views of the holding clip employed for holding the stripper shoes in the operative position.

Figure 7A:
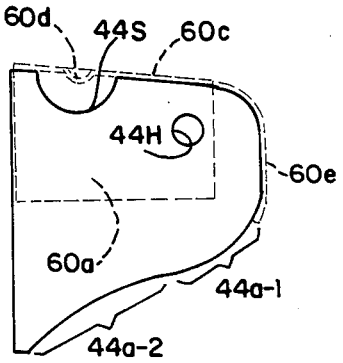
Figure 7B:
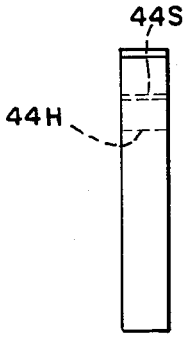

FIGS. 7*a* and 7*b* show side end views of one stripper shoe.

Figure 8A:
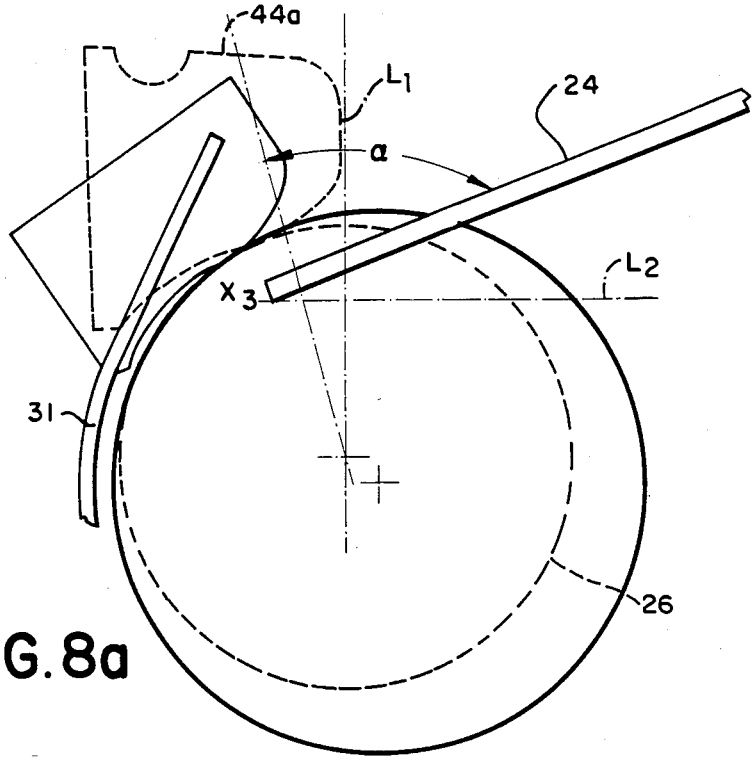

FIG. 8*a* shows an elevational view comparing the conventional stripper and feed roller arrangement with the arrangement of the present invention.

Figure 8B:
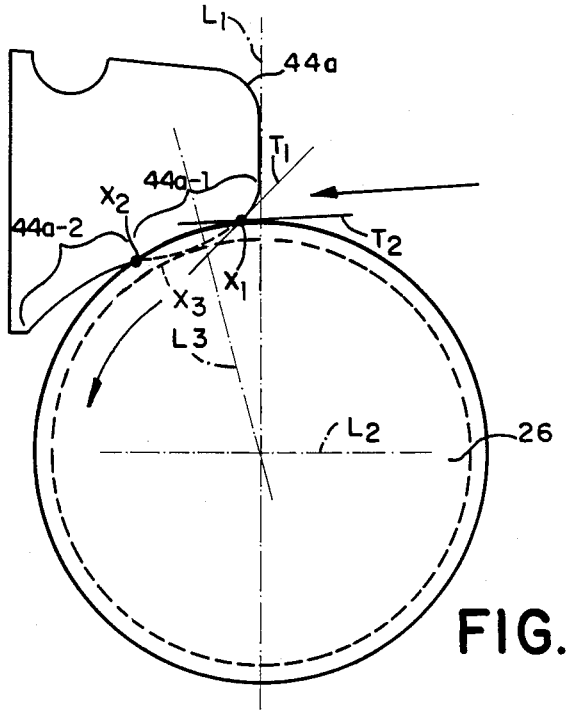

FIG. 8*b* is an enlarged view of the stripper and feed roller arrangement of the present invention.

DETAILED DESCRIPTION OF THE INVENTION

FIG. 1 shows sheet handling and counting apparatus 10 embodying the principles of the present invention, the housing for said apparatus being comprised of housing portions 12, 14, 16 and 18 shown respectively in FIGS. 1, 4a and 4b. The sheet handling and counting apparatus 10 shown in FIG. 1 is arranged within the main housing portion or chassis 12 which is shown in FIG. 4a and comprises a base 12a, generally triangular-shaped side-walls 12b and 12c, rear wall 12d having a large opening 12e, top wall 12f and diagonally upwardly extending portions 12h and 12i on sidewalls 12b and 12c. Portions 12h and 12i have openings (to be more fully described) for securing elongated, substantially rectangular-shaped housing 14a (FIG. 4b) which contains the system electronics. The numbered openings in the sidewalls 12b, 12c represent the shafts supported by these openings. Opening 14b in front wall 14a of housing 14 exposes the control panel operating members (not shown for purposes of simplicity). A display panel (not shown) is positioned in opening 14d.

Side covers, not shown, are arranged to cover the mechanical mechanisms and other components projecting beyond and/or mounted along the outer surfaces of triangular-shaped side-walls 12b and 12c. A plate 17 is positioned across the forward open end of the chassis and has: a curved portion 17a which is aligned with the sheet accelerating assembly (to be described below) and is provided with slots 17b, 17c through which the stacker wheels extend. Ribs 17d guide sheets from the acceleration assembly towards the stacker wheels.

The rear opening 12e in housing portion 12 shown in FIG. 4a is covered with a releaseable cover member (not shown) to enable access to the rear of chassis 12.

An output tray 27 is joined to chassis 12 for receiving and stacking sheets delivered to the output tray.

The electronics and display enclosure 14 shown in FIG. 4b has a top surface 14f which serves as the floor 24 of input tray 22 (see also FIG. 1) for receiving a stack of sheets to be counted.

Movable sidewalls 23, 25 define the side supports for supporting a stack of sheets and move either in unison or individually either further apart or closer together to adjust the input tray side supports to accomodate a stack of sheets of any size within certain predetermined limits, as will be more fully described.

The upper portion of the apparatus 10 shown in FIG. 1 includes input tray 22 with floor 24 for receiving a stack of sheets to be counted. The sheets move through apparatus 10 and, after being handled and counted, are neatly stacked in output tray 27.

Figure 2:
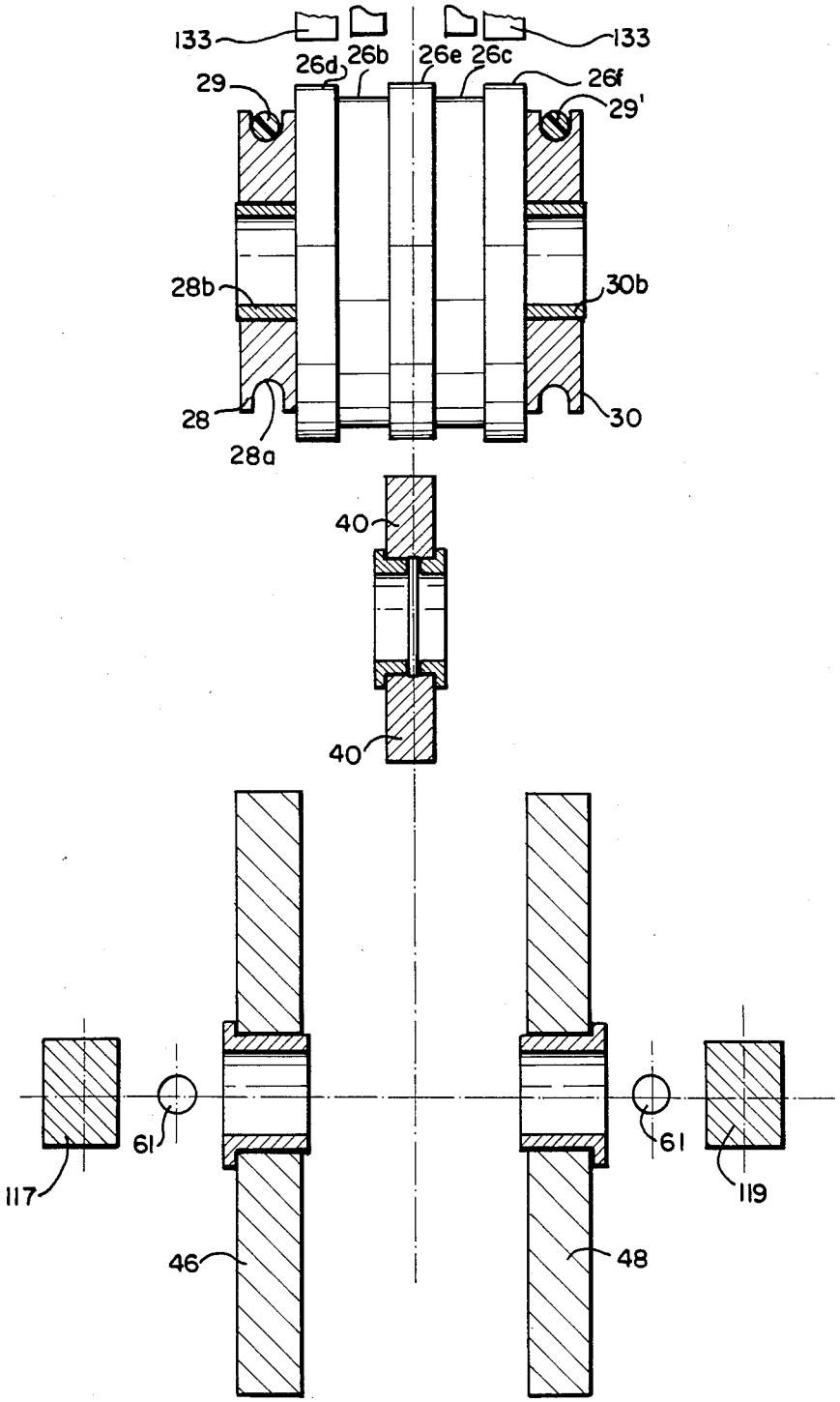
FIG. 2 shows an exploded view of the stripper shoes and feed, acceleration and pinch rolls employed in the arrangement of FIG. 1 in greater detail.

Input tray 24 is comprised of an inclined supporting surface 14f (see also FIG. 4b) which supports a stacks of sheets. Rear supporting surface 16a-1 (see FIG. 1) provided at the lower end of surface 16a, engages the leading edges of a group of sheets at the bottom of the stack of sheets and serves to "fan" the stack of sheets to facilitate the feeding operation. The leading edges of the bottom group of sheets within the stack move toward a nip $N_1$, defined by feed roller 26 mounted upon shaft 26a. Shaft 26a is supported by openings 12b-1 and 12c-1 in chassis sidewalls 12b, 12c. The feed roller 26, which is shown in detail in FIG. 2, is formed of a suitable rubber or rubber-like material having a durometer of the order of 65 SHORE A. The feed roller 26 is provided with two rectangular-shaped annular grooves 26b, 26c which cooperate to form three (3) rectangular-shaped annular projecting portions 26d, 26e and 26f of increased diameter relative to annular recesses 26b and 26c.

Bearings 28b and 30b freewheelingly mount pulleys 28 and 30 upon shaft 26a. Pulley 28 is provided with an annular groove 28a of substantially semi-circular-shaped cross-section for receiving and supporting a resilient O-ring 29, entrained about groove 28a of pulley 28 and the groove 32a of an acceleration pulley 32 shown in FIGS. 1 and 3, for imparting drive to pulley 28 through pulley 32 and O-ring 29.

Pulley 30, positioned on the opposite side of feed roller 26, is provided with an annular groove 30a of substantially semi-circular cross-section. Pulley groove 30a receives a resilient O-ring 29' shown in FIG. 3 and which is similar to O-ring 29. O-ring 29' is received within a groove 34a in acceleration pulley 34 shown in FIG. 3 and which is substantially identical to acceleration pulley 32 shown in FIGS. 1 and 3.

An O-ring 35 (see FIG. 3) is arranged within annular groove 113a of pulley 113 and in an annular groove 37a of pulley 37 provided on shaft 39a. Picker roller 39 arranged on shaft 39a drives the bottom sheet of the stack from tray 24 into nip $N_1$.

Swingable guide plate 31 (see FIGS. 1, 5a, 5c) has: a curved portion 31a, which curves about feed roller 26 as shown best in FIG. 1; a substantially straight upper portion 31b which extends towards straight portion 16a-1 and a straight lower portion 31c which extends towards output tray 27. The portion 17a of cover 17 (see FIGS. 3a and 4b) curves about the stacker wheels to guide sheets to the stacker wheels, as will be more fully described.

The curved guide plate 31 forms an integral part of a guide plate assembly 50 (see FIGS. 5a to 5g) and is provided with an opening 31a-1 (FIG. 5a) through which feed pinch wheel 40 extends. Pinch wheel 40 rollingly engages central portion 26e of feed wheel 26, as can be seen in FIG. 2, to form a nip $N_2$. The pinch wheel shaft 40a extends through a pair of elongated, oval-shaped openings 41a, 41a in support plates 41, 41, which plates are integrally joined to guide plate 31 of swingably mounted guide plate assembly 50 to be more fully described. Spring means 42, 42 encircle pin 42a, have the ends of arms 42b, 42b secured to plates 41, 41 and have the opposite ends of arms 42b, 42b arranged to engage the shaft 40a to resiliently urge the feed pinch wheel 40 against feed wheel 26.

The stripper assembly 44 (FIGS. 1, 5d, 5e, 5f) is comprised of a pair of individual stripper members 44a, 44b, having a durometer of 80±5, Shore A, removably mounted upon a mounting member 53 forming part of swingably mounted guide plate assembly 50, which assembly 50 is pivoted about pivot pin 45a for swingably moving stripper assembly 44, feed pinch roller 40, and acceleration pinch rollers 46 and 48 into and out of their operative positions. A pin 44c extends through openings in stripper shoes 44a, 44b and opening 53a in mounting member 53 (FIG. 5d) to hold the stripper shoes on member 53. A stripper clip 60 (FIGS. 6a, 6b) snaps upon stripper shoes 44a, 44b (FIGS. 7a, 7b) so that arms 60a, 60b press stripper shoes 44a, 44b towards mounting member 53 and hold pin 44c in place. The indentation 60d in the top 60c of clip 60 enters the slots 44s, 44s in stripper shoes 44a, 44b to properly mount clip 60 relative to shoes 44a, 44b. The forward end 60e curves about the forward ends of stripper shoes 44a, 44b to protect the forward ends of the stripper shoes 44a, 44b and to reduce the sliding friction between the stripper shoes and the incoming sheets to facilitate feeding of sheets into the feed nip $N_1$.

Acceleration pinch wheels 46 and 48, shown in FIGS. 1 and 2, are each mounted upon a common shaft 46a, which is arranged for slidable movement within an elongated oval-shaped pair of openings 49b, 49b provided in mounting brackets 49, 49 integrally joined to guide plate 31 of swingable guide plate assembly 50. Each of the acceleration pinch wheels 46 and 48 is urged against its associated acceleration wheel O-ring 33, 33, shown in FIGS. 1 and 3, by means of torsion springs 51 having one end portion 51a arranged around pin 45a and having the other end portion 51b arranged around shaft 46a.

By moving swingably mounted guide plate assembly 50 counterclockwise about pivot 45 (see arrow A), wheels 40, 46 and 48 are moved away from cooperating wheels 26, 32 and 34, respectively and the stripper assembly 44 is moved away from feed wheel 26 to facilitate inspection, maintenance and repair operations. The assembly 50 may be swung clockwise (arrow B) to return the last-mentioned components to the operative position.

The stripper members 44a, 44b each have a curved lower surface as shown in FIGS. 1 and 7a, the surface being comprised of a convex curved portion 44a-1 and a concave curved surface portion 44a-2 joining the convex curved surface portion 44a-1. The right-hand end of the convex curved surface 44a-1 forms a tapering entrance region or throat with the feed wheel 26. The width of each stripper 44a, 44b is less than the width of the associated groove 26b, 26c (FIG. 2) provided in feed roller 26, enabling the left-hand-most portion of the convex curved surface to preferably extend at least slightly into its associated recess 26b, 26c. The upstream end of the convex surface portion cooperates with the periphery of portions 26d, 26e and 26f of feed roller 26 to define a tapered throat for guiding the leading edge of a sheet into the feed nip $N_1$, (see FIGS. 1 and 8b). The downstream end of each of the stripper shoes 44a, 44b extends at least partially into an associated one of the grooves 26b, 26c. At the point $X_2$ (FIG. 8b) where the rearward end of the convex surface portion intersects with the periphery of the feed roller 26, the surface is concave. The concave surface portion 44a-2 lies outside of the periphery of feed roller 26. The point $X_3$ represents the portion of the convex surface of the stripper shoes which makes the deepest penetration into the cooperating recess 26b, 26c of feed roller 26. The point $X_3$ of deepest penetration is oriented so that the line $L_3$ passing through the axis of rotation of feed roller 26 and the point $X_3$ (hereinafter referred to as the "pinch line") forms an angle of $15° \pm 5°$ with imaginary vertical line L to yield the optimum desired results of feeding sheets one-at-a-time without damaging or scuffing the handled sheets.

The supporting surface 24 of the input tray is preferably inclined at an angle of $23° \pm 5°$ to the imaginary horizontal line $L_2$ to optimize feeding of sheets from the input tray into feed nip $N_1$. The relationship between the inclination of the input tray and the orientation of the stripper shoes is such that the angle therebetween is equal to $15° = (90° - 23°) = 15° + 67° = 82° \pm$ °, and is preferably $82° \pm 8°$.

Although the preferred stripping surface of the stripper shoe has a shape and contour, for example, as shown in FIG. 8a, the stripping surface may have a convex contour such as a round or circular shaped periphery. As another alternative, the convex stripping surface need not penetrate into a recess in the feed roller and need only be positioned in close proximity to the periphery of the feed roller. Regardless of the amount of penetration, it is nevertheless important that the pinch line $L_3$ forms an angle of $15° \pm 5°$ with the imaginary vertical line and preferably that the pinch line form an angle of $82° \pm 8°$ and most preferably an angle of $82° \pm 5°$.

In the absence of sheets, the stripper shoes 44a, 44b do not engage feed roller 26. In the presence of sheets, and due to the partial projection of each stripper shoe 44a, 44b into an associated recess 26b, 26c of feed roller 26, each sheet fed into nip $N_1$ is urged into an undulating configuration which stiffens the sheets and greatly facilitates feeding of the sheets.

Also, the diameter of the feed roller is preferably reduced of the order of 14 to 15 percent relative to feed rollers employed in conventional apparatus, providing a feed roller having an outer periphery with a radius of curvature smaller than that of conventional feed rollers. The diameter of feed roller 26 is preferably $1.5'' \pm 0.2''$. FIG. 8a shows the conventional arrangement and the arrangement of the present invention superimposed upon one another. Dotted roller 26 and dotted stripper shoes 44a represent the arrangement of the present invention. Roller R and stripper shoe S shown in solid-line fashion represent the conventional arrangement. Plates 24 and 31 respectively represent the floor of the input tray and the guide plate (see FIG. 1). This arrangement has the unique, remarkable and totally unexpected result of reducing damage to processed sheets of the order of 99% or greater and substantially eliminating the nicking or cutting of the leading edges of the handled sheets entering the nip $N_1$. The new design also prevents mutilated sheets from being damaged and prevents sheets from developing rolled edges as a result of sheet handling by the apparatus. Streaks and scuffs normally found on sheets such as brand new paper currency are also totally eliminated by the design of the present invention. The conventional arrangement does not provide these unique results.

The feed wheel 26 is formed of a material having a greater coefficient of sliding friction than the stripper members 44. When a single sheet is fed into nip $N_1$, the feed wheel 26 exerts a greater force upon the single sheet than the drag force imparted to the sheet by the stripper members 44a, 44b, causing the sheet to move in the forward feed direction. In the event that two or more sheets are fed into nip $N_1$, the frictional force exerted upon the bottom sheet by feed roller 26 is greater than the force exerted upon the top of the bottom sheet by the upper sheet, causing the bottom sheet to be moved in the forward feed direction. Conversely, the force exerted by the stripper members 44a, 44b upon the top surface of the upper sheet is greater than the force exerted upon the bottom surface of the upper sheet by the lower sheet, preventing the upper sheet from moving in the forward feed direction and thereby feeding only single sheets through nip $N_1$. Substantially the same operation occurs with multiple feed sheets greater than two in number.

Single fed sheets passing through nip $N_1$ are guided through a curved guide path formed by plate portion 31a and feed wheel 26. The leading edge of the sheet passing through nip $N_1$ approaches and enters nip $N_2$ formed between feed roller 26 and idler roller 40 to provide positive feeding of the sheet about the curved guide path.

The leading edge of the aforementioned sheet passes through nip $N_2$ and enters into a guide region defined by the straight portion 31*c* of plate 31 and the O-rings 29, 29' entrained about the pulleys 28, 30 mounted upon the same shaft 26*a* as feed roller 26 and the pulleys 32, 34. The O-rings 29, 29' form an acceleration nip $N_3$ with the acceleration pinch wheels 46, 48. When the leading edge of a sheet enters nip $N_3$, the sheet is abruptly accelerated in the forward feed direction and moved along the lower end of guide plate 31*c* and a cooperating guide surface 58 (FIG. 1). The leading edge of a sheet eventually enters into a pocket 56*a* formed by a pair of adjacent flexible blades 56*b*, 56*b'* provided on the stacker wheels 56. The sheet is delivered to the base portion 27*a* of input tray 27 which strips the sheet from its pocket 56*a* and stacks the sheet in the output tray 27. Portions 27*b*, 27*c* of the input tray served to hold the stack of accumulating sheets in a generally upright position.

FIGS. 5*a* through 5*f* show the guide plate assembly 50 in greater detail as being comprised of guide plate 31 having opening 31*a*-1 through which the feed roller pinch wheel 40 extends and openings 31*e*, 31*f* through which the acceleration pinch wheels 46, 48 extend (FIG. 1). Arms 49, 49 are integrally joined to the rear of guide plate 31 and are each provided with opening 49*a* for receiving a pivot pin 45*a* for swingably mounting assembly 50 to the stacking apparatus frame. Elongated openings 49*b* each receive a common shaft 46*a*, which rotatably support the acceleration pinch wheels 46 and 48 a spacer 47 maintains the pinch rollers 46, 48 in a properly spaced apart arrangement to align rollers 46, 48 with the openings 31*e*, 31*f* in guide plate 31. Torsion spring 57 shown in FIG. 1 urges the shaft 46*a* of the acceleration pinch wheels 46, 48 toward the acceleration roller 32. The pinch wheels 46, 48 rollingly engage the O-rings 29, 31 (FIG. 3).

Arms 41, 41 integrally joined to the rear surface of guide plate 31 are each provided with an elongated opening 41*a* which receives the common shaft 40*a* of feed wheel pinch roller 40. The aforementioned torsion spring 42 urges shaft 40*a* and hence roller 40 towards feed roller 26. The pinch roller 40 engages the surface of the central projection 26*e* of feed wheel 26, providing positive driving of the sheet just as the sheet is ready to leave the influence of the feed wheel 26. In addition, the orientation of the pinch roller 40 relative to the feed wheel and the acceleration nip $N_3$ assures that the sheets are positively driven in the proper direction. Pinch roller 40 also cooperates with the feed roller to hold a sheet which is in nip $N_2$ when the apparatus is abruptly halted to prevent that sheet from reaching the acceleration nip $N_3$.

Openings 31*g*, 31*h* in guide plate 31 are provided to permit the passage of light from light sources designated LED (see FIG. 1) mounted upon guide plate 58. Suitable openings are provided in guide plate 58 through which the feed roller 26, acceleration rollers 32, 33, and O-rings 29, 29' extend. Sensors 61 are mounted upon plate 31 and are aligned with openings 31*g*, 31*h* and function as count sensors to detect the passage of a gap between sheets for sheet counting purposes.

The O-rings 29, 29' prevent sheets moving between the second feed nip $N_2$ and the acceleration nip $N_3$ from moving away from the feed path and also aid in moving the sheet towards nip $N_3$. A gap space is provided for the O-ring surfaces in the region of the feed nip $N_1$ to allow the leading edge of a light or curled sheet to engage the O-rings and thereby provide positive feed to incoming sheets, assisting the picker roller 39 in feeding sheets into the first feed nip $N_1$. A dancer roller assembly 130 is comprised of an arm 131 swingably mounted to a shaft 132 extending through an opening 131*a* in arm 131 and openings 41*c*, 41*c* in arms 41, 41. A pair of rollers 133, 133 are freewheelingly mounted upon a shaft extending through an opening 131*b* in arm 131 (see FIG. 2). Rollers 133, 133 are each arranged to cooperate with feedwheel 26 and lightly engage the surfaces 26*d*, 26*f* of the feedwheel to assist in the feeding of light, fluffy sheets. Stiffer sheets simply move the dancer rollers away from the feedwheel 26. The dancer rollers also provide sufficient drive friction to assure feeding of the last few sheets in the input tray into the feed nip $N_1$.

The swingable movement of guide plate assembly 50 provides ready access to the components mounted thereon as well as the components facing the guide plate 31, thus greatly facilitating inspection, maintenance and repair of the equipment. Shaft 71 (FIG. 1) cooperates with a spring 73 for releaseably securing assembly 50 in the operating position. The curved end 73*a* of spring 73 releaseably snaps onto post 71 (see FIGS. 1 and 3*a*). Threaded member 75 threadedly engages the tapped aperture 67*a* and bears against post 71 to easily and yet accurately adjust the location of the stripper shoes 44*a*, 44*b* relative to feed roller 26.

The apparatus 10 of FIG. 1 is capable of handling sheets of varying length measured in the feed direction without any adjustment whatsoever. The only adjustment provided is the sliding movement of the side-wall members 23, 25 (see FIG. 4*b*) provided for alignment of sheets of varying length measured in a direction perpendicular to the feed direction. Side-wall supports 23, 25 are movable either closer together or farther apart to facilitate the formation and maintaining of a neat, upright stack within the input tray preparatory to a sheet handling and counting operation.

The power train for the sheet handling apparatus of FIG. 1 is shown best in FIGS. 3 and 3*a* and includes motor M driving a pulley 77 having a pair of grooves 77*a* for receiving a pair of O-rings 79 which are entrained about grooves 77*a* in pulley 77 and grooves 83*a* in pulley 83 rovided on stationary shaft 81. The pulley 83 is freewheelingly mounted upon shaft 81. Integral therewith are pulleys 85 and 87. Pulleys 83, 85 and 87 rotate as an integral unit and are freewheelingly mounted upon shaft 81. O-ring 89 is entrained about the groove 87*a* in pulley 87 and the groove 91*a* in pulley 91 mounted upon shaft 93. A flywheel 95 is mounted upon shaft 93. One-way clutch assembly 96 (FIG. 3) is coupled between shaft 93 and pulley 91 to enable shaft 93 and flywheel 95 to continue rotation when motor M has been abruptly halted. The left-hand end of shaft 93, which is supported by bearings 97*a*, 97*a* mounted within housing 99, rollingly engages the rubber surface of roller 101 secured to the stacker wheel shaft 56*c*. Housing 99 further incorporates bearing 97*b* for mounting shaft 56*c*.

O-rings 103 are entrained about the grooves 85*a* in pulley 85 provided on stationary shaft 81 and bear against the grooves 105*a* in pulley 105 and are entrained about grooves 107*a* of pulley 107 mounted upon the feed assembly shaft 26*a*. Pulley 107 is secured to shaft 26a. Pulley 109 is integral with pulley 107 and is provided with grooves 109a receiving O-rings 112 which are entrained about grooves 109a and grooves 111a provided in pulley 111 mounted upon shaft 32b. Pulley 111 is secured to shaft 32b and rotates shaft 32b, as well as acceleration pulleys 32 and 34. The O-rings 29 and 29' entrained about grooves 32a and 34a of pulleys 32 and 34 and about grooves 28a and 30a in pulleys 28 and 30, rotate the pulleys 28 and 30, which are freewheelingly mounted upon feed shaft 26a, at an angular velocity which is significantly greater than the angular velocity of feed roller 26.

A pulley 113, integral with pulleys 107 and 109, is further provided on shaft 26a. O-ring 35 which is entrained about groove 113a of pulley 113 and groove 37a of pulley 37 mounted upon picker wheel shaft 39a, imparts rotation to picker wheel 39.

An encoder 115 is mounted upon shaft 32b and provides timing pulses for use by the electronic controls employed for operating the apparatus 10. The pulse rate of the pulses generated by encoder 115 is a function of the output speed of motor M. Thus, any changes in motor speed is directly indicated by encoder 115.

The operation of the apparatus is a follows:

Motor M is energized causing rotation of feed roller 26, acceleration pulleys 32 and 34, picker roller 39, acceleration idlers 28 and 30 and the stacker wheels 26. The tangential velocity of the acceleration pulleys 32 and 34 is significantly greater than the tangential velocity of the periphery of feed roller 26, causing the tangential velocity of the O-rings on the freewheeling pulleys 28 and 30 to be greater than the tangential velocity of feed roller 26. O-rings 29, 29' and dancer rollers 133, 133 aid in the feeding of the light, fluffy sheets into feed nip $N_1$. Sheets are accelerated by nip N3, being positively fed thereto by nip $N_2$. Accelerated sheets are fed to stacker wheels 56 and are ultimately stripped from the stacker wheel pockets 56a and collected in the output tray.

If, for any reason the motor M is halted the picker roller 39, acceleration pulleys 32 and 34, feed roller 26 and acceleration idlers 28 and 30 are abruptly halted. However, the one-way clutch assembly 97 disengages pulley 91 from shaft 93. The inertia of flywheel 95 causes the flywheel to continue rotating thereby rotating shaft 93 which rotates stacker shaft 56c and stacker wheels 56 through roller 101, thus assuring that sheets which have reached stacker wheels 56 are delivered to the output tray 27. When motor M is abruptly halted, any sheets between the nips $N_1$, $N_2$ or $N_3$ are also abruptly halted, thus assuring an accurate count of sheets reaching the output tray 27.

A sheet entering acceleration nip $N_3$ is abruptly accelerated causing a wider gap between the trailing edge of the accelerated sheet and the leading edge of the next sheet being feed toward nip $N_3$ to facilitate counting, which is accomplished by the LED light sources and cooperating sensors 61.

The apparatus may also be provided with magnetic sensing means utilized to detect suspect counterfeit currency. The sensing apparatus is comprised of a pair of magnetic heads 117 and 119 shown in FIG. 2. The sensing heads 117, 119 are arranged within openings 31j and 31k in guide plate 31 shown in FIG. 5a. Openings 31m and 31n, also provided in guide plate 31 each receive a permanent magnet member, causing those portions of the currency being processed moving over the magnetic heads 117, 119 to pass through magnetic fields created by these magnetic heads, thereby exerting an influence upon ferromagnetic particles contained within the ink utilized to print the paper currency. These particles experience some magnetization and, when these magnetized particles move over the sensors 117, 119, the magnetic head sensors generate electrical signals, the presence of which indicate genuine currency and the absence of which indicate suspect counterfeit currency.

The sensitivity of the counterfeit detection apparatus is greatly enhanced by the provision of freewheeling rollers 123, 125 (see FIGS. 3 and 5a) which rollers are freewheelingly mounted upon acceleration shaft 32b to urge the bills toward the magnetic head sensors. The freewheeling rollers 123, 125, being free to rotate independently of shaft 32b, do not cause any wearing of the paper currency. The periphery of each roller is spaced from the associated magnetic head sensor to prevent any sliding engagement therebetween in the absence of sheets thus avoiding any unnecessary wearing of the magnetic head sensors.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for handling and counting sheets comprising:

an input tray for receiving a stack of sheets, each having a nominal thickness;

a rotatable feed roller;

picker means for advancing the bottom sheet in a stack of sheets placed in the input stacker along a predetermined path toward said feed roller;

means for accelerating sheets;

the periphery of said feed roller having an annular groove;

stationary stripper means cooperating with the feed roller to form a feed nip for feeding single sheets delivered from the input tray to said sheet acceleration means in a one-at-a-time fashion to facilitate examination of the sheets and for preventing the passage of double-fed sheets to said sheet acceleration means;

said stripper means comprising a stripper surface having a convex surface portion, extending toward the bottom of said annular groove for a distance to leave a gap between said groove bottom and said convex surface portion of less than said nominal thickness, an imagininary line passing through the point on said convex surface closest to said feed roller and the axis of rotation of said feed roller defining a pinch line, said pinch line forming an angle of between 15° plus or minus 5° with an imaginary vertical line passing through the axis of rotation of said feed roller to limit the passage of sheets beyond the feed nip to single sheets while preventing passage of double-fed sheets beyond the feed nip and at the same time the leading edges and surfaces of the sheets from being damage or abraded by said feed roller and stripper means;

a member having a curved surface covering a portion of the stripper means convex surface portion forward of the feed nip and having a surface with low coefficient of sliding friction as compared with said convex surface to reduce the friction experienced by sheets engaging said low friction surface and to reduce wearing of the stripper means and sheets being processed;

said curved member comprising a clip;

a mounting means for mounting the stripper means;

said clip retaining said stripper shoes on said mounting means;

said stripper means comprising first and second shoe members each having an opening;

said mounting means having an opening;

a pin extending through the openings in said mounting means and said shoe members, which are arranged on opposite sides of said mounting means;

said clip being resilient and having a C-shaped configuration having a central portion and integral sides embracing said stripper shoe member and holding the shoe members against said mounting means and holding said pin in said openings.

2. The apparatus of claim 1 wherein the curved surface is provided on a curved portion which is integral with and extends downwardly from the central portion between said integral sides and snap-fits about the ends of the stripper shoe members forward of the feed nip.

3. Apparatus for handling and counting sheets comprising:

an input tray for receiving a stack of sheets, each having a nominal thickness;

a rotatable feed roller;

picker means for advancing the bottom sheet in a stack of sheets placed in the input stacker along a predetermined path toward said feed roller;

means for accelerating sheets;

the periphery of said feed roller having an annular groove;

stationary stripper means cooperating with the feed roller to form a feed nip for feeding single sheets delivered from the input tray to said sheet acceleration means in a one-at-a-time fashion to facilitate examination of the sheets and for preventing the passage of double-fed sheets to said sheet acceleration means;

said stripper means comprising a stripper surface having a convex surface portion, extending toward the bottom of said annular groove for a distance to leave a gap between said groove bottom and said convex surface portion of less than said nominal thickness, an imagininary line passing through the point on said convex surface closest to said feed roller and the axis of rotation of said feed roller defining a pinch line, said pinch line forming an angle of between 15° plus or minus 5° with an imaginary vertical line passing through the axis of rotation of said feed roller to limit the passage of sheets beyond the feed nip to single sheets while preventing passage of double-fed sheets beyond the feed nip and at the same time the leading edges and surfaces of the sheets from being damaged or abraded by said feed roller and stripper means;

rotatable feed pich wheel means rollingly engaging said feed roller forming a driving nip downstream of said feed nip for positively advancing a sheet passing the stripper means toward said acceleration means;

said acceleration means comprising a pair of acceleration rollers rotatably mounted upon a common axis;

first and second idler rollers freewheelingly mounted on a common axis with said feed roller;

resilient O-rings each entrained about one of said first and second idler rollers and an associated one of said acceleration rollers for rotating said idler rollers;

the diameter of said feed roller being greater than the diameter of said first and second idler rollers;

first and second rotatable acceleration pinch wheels each rollingly engaging one of said O-rings at a location where the O-rings engage their associated acceleration rollers to form first and second acceleration nips for accelerating a sheet which moves into said acceleration nips;

a swingable mounting for supporting the feed and acceleration rollers and movable between a first position in which the feed and acceleration rollers respectively engage the feed roller and the O-rings entrained about the acceleration pulleys, and a second position in which the feed and acceleration rollers are respectively displaced from the feed roller and the last-mentioned O-rings;

magnetizing means supported by said swingable mounting for generating a magnetic field through which said sheets pass when the swingable mounting is in the first position;

magnetic field sensing means supported by said swignable mounting for sensing the presence of a changing magnetic field generated by particles on a passing sheet magnetized by said magnetizing means when the swingable mounting is in the first position.

4. The apparatus of claim 3 further comprising a guide roller mounted for freewheeling rotation about said common axis the periphery of said guide roller being in close proximity to said sensing means to assure that sheets moving about the periphery of said guide roller are in close proximity to the sensing means to facilitate sensing of the field generated by the particles on said sheets.

5. Apparatus for handling and counting sheets comprising:

an input tray for receiving a stack of sheets, each having a nominal thickness;

a rotatable feed roller;

picker means for advancing the bottom sheet in a stack of sheets placed in the input stacker along a predetermined path toward said feed roller;

means for accelerating sheets;

the periphery of said feed roller having an annular groove;

stationary stripper means cooperating with the feedroller to form a feed nip for feeding single sheets delivered from the input tray to said she-t acceleration means in a one-at-a-time fashion to facilitate examination of the sheets and for preventing the passage of double-fed sheets to said sheet acceleration means;

said stripper means comprising a stripper surface having a convex surface portion, extending toward the bottom of said annular groove for a distance to leave a gap between said groove bottom and said convex surface portion of less than said nominal thickness, an imaginary line passing through the point on said convex surface closed to said feed roller and the axis of rotation of said feed roller defining a pinch line, said pinch line forming an angle of between 15° plus or minus 5° with an imaginary vertical line passing through the axis of rotation of said feed roller to limit the passage of sheets beyond the feed nip to single sheets while preventing passage of double-fed sheets beyond the feed nip and at the same time the leading edges and surfaces of the sheets from being damaged or abranded by said feed roller and stripper means;

rotatable feed pinch wheel means rollingly engaging said feed roller forming a driving nip downstream of said feed nip for positively advancing a sheet passing the stripper means towards said acceleration means;

means for movably mounting said feed pinch wheel means and including bias means for resiliently urging said feed pinch wheel means into rolling engagement with said feed roller;

an output tray;

a rotatable stacker wheel having a plurality of curved flexible blades, adjacent blades forming curved pockets each for receiving a sheet driven into a pocket by said acceleration nips and for carrying the leading edge of each sheet in a pocket to the output tray;

a stripper surface for stripping each sheet from the stacker wheel as the leading edge of the sheet engages the stripper surface whereby each stripped sheet is deposited in said output stacker;

a shaft for rotatably supporting said stacker wheel;

a drive train for driving said stacker wheel shaft comprising a rotatable stacker wheel drive shaft;

a high friction roller having its periphery in firm rolling engagement with the periphery of said stacker wheel driving shaft;

said high friction roller being secured to a shaft for rotatably supporting said stacker wheel driving shaft;

pulley means on said stacker wheel driving shaft;

pulley means on said stacker wheel driving shaft;

means coupling the output of a motor to said pulley means.

6. The apparatus of claim 5 further comprising clutch means coupled between said pulley means and said stacker wheel driving shaft normally coupling drive from the pulley means to the stacker wheel driving shaft and permitting freewheeling rotation of said stacker wheel driving shaft only when said motor is halted by decoupling said stacker wheel driving shaft from said pulley means;

rotatable flywheel means for rotating said stacker wheel driving shaft when said stacker wheel driving shaft is decoupled from said pulley means upon halting of said motor.

* * * * *

UNITED STATES PATENT AND TRADEMARK OFFICE

CERTIFICATE OF CORRECTION

PATENT NO. : 4,796,878

DATED : January 10, 1989

INVENTOR(S) : William Nichelson, Gordon H. Groff, Paul C. Jones

It is certified that error appears in the above-identified patent and that said Letters Patent is hereby corrected as shown below:

Claim 1, col. 10, line 63,

"damage" should read -damaged--;

col. 11, line 17,

"member" should read --members--;

Claim 3, col. 11, line 61,

"pich" should read --pinch--;

col. 12, lines 27-28,

"swignable" should read --swingable;

Claim 5, col. 12, lines 52-53,

"fee-droller" should read --feed-roller--;

col. 12, line 54,

"she-t" should read --sheet--;

col. 12, line 65,

"closed" should read --closest--;

UNITED STATES PATENT AND TRADEMARK OFFICE

CERTIFICATE OF CORRECTION

PATENT NO. : 4,796,878

DATED : January 10, 1989

INVENTOR(S) : William Nichelson, Gordon H. Groff, Paul C. Jones

It is certified that error appears in the above-identified patent and that said Letters Patent is hereby corrected as shown below:

Claim 5, col. 13, line 7,

"abranded" should read --abraded--;

col 14, line 13,

"pulley means on said stacker wheel driving shaft;" is a duplication of line 12 and should be deleted.

Signed and Sealed this

Second Day of May, 1989

*Attest:*

*Attesting Officer*

DONALD J. QUIGG

*Commissioner of Patents and Trademarks*